US007381697B2

(12) United States Patent
Lentsch et al.

(10) Patent No.: US 7,381,697 B2
(45) Date of Patent: Jun. 3, 2008

(54) FABRIC SOFTENER COMPOSITION AND METHODS FOR MANUFACTURING AND USING

(75) Inventors: Steven E. Lentsch, St. Paul, MN (US); Victor F. Man, St. Paul, MN (US); Jaclyn J. Tilleskjor, Vadnais Heights, MN (US)

(73) Assignee: Ecolab Inc., St. Paul, MN (US)

( * ) Notice: Subject to any disclaimer, the term of this patent is extended or adjusted under 35 U.S.C. 154(b) by 689 days.

(21) Appl. No.: 10/120,891

(22) Filed: Apr. 10, 2002

(65) Prior Publication Data

US 2003/0195130 A1 Oct. 16, 2003

(51) Int. Cl.
*C11D 17/00* (2006.01)

(52) U.S. Cl. ..... 510/519

(58) Field of Classification Search ..... 510/519
See application file for complete search history.

(56) References Cited

U.S. PATENT DOCUMENTS

| | | | | |
|---|---|---|---|---|
| 3,442,692 | A | | 5/1969 | Gaiser |
| 3,632,396 | A | | 1/1972 | Perez-Zamora |
| 3,634,947 | A | | 1/1972 | Furgal |
| 3,650,816 | A | * | 3/1972 | Rudy et al. ..... 427/11 |
| 3,676,199 | A | | 7/1972 | Hewitt et al. |
| 3,686,025 | A | | 8/1972 | Morton |
| 3,796,599 | A | | 3/1974 | McLaughlin |
| 3,804,330 | A | | 4/1974 | Miller, Jr. et al. |
| 3,806,359 | A | | 4/1974 | McLaughlin |
| 3,822,145 | A | | 7/1974 | Liebowitz et al. |
| 3,870,145 | A | | 3/1975 | Mizuno |
| 3,936,538 | A | | 2/1976 | Marshall et al. |
| 3,947,971 | A | | 4/1976 | Bauer |
| 3,948,387 | A | | 4/1976 | Haertle |
| 3,963,629 | A | | 6/1976 | McLaughlin |
| 3,967,008 | A | | 6/1976 | Mizuno et al. |
| 3,972,131 | A | | 8/1976 | Rudy et al. |
| 3,991,479 | A | | 11/1976 | Dionne |
| 4,004,685 | A | | 1/1977 | Mizuno et al. |
| 4,014,432 | A | | 3/1977 | Clothier et al. |
| 4,035,307 | A | | 7/1977 | Fry et al. |
| 4,041,205 | A | | 8/1977 | Compa et al. |
| 4,053,992 | A | | 10/1977 | Furgal |
| 4,085,052 | A | | 4/1978 | Murphy et al. |
| 4,095,946 | A | | 6/1978 | Jones et al. |
| 4,098,937 | A | | 7/1978 | Mizuno et al. |
| 4,105,813 | A | | 8/1978 | Mizuno |
| 4,134,838 | A | * | 1/1979 | Hooper et al. ..... 510/518 |
| 4,139,477 | A | | 2/1979 | Hayek et al. |
| 4,142,978 | A | | 3/1979 | Murphy |
| 4,157,307 | A | | 6/1979 | Jaeger et al. |
| 4,237,155 | A | | 12/1980 | Kardouche |
| 4,252,656 | A | | 2/1981 | Liebowitz et al. |
| 4,254,139 | A | | 3/1981 | Hendrickson et al. |
| 4,308,159 | A | | 12/1981 | Sprecker |
| 4,567,675 | A | | 2/1986 | Rennie |
| 4,570,888 | A | | 2/1986 | Evans |
| 4,733,774 | A | | 3/1988 | Ping, III et al. |
| 4,749,596 | A | | 6/1988 | Evans et al. |
| 4,753,389 | A | | 6/1988 | Davis |
| 4,756,850 | A | | 7/1988 | Nayar |
| 4,764,289 | A | | 8/1988 | Trinh |
| 4,767,548 | A | | 8/1988 | Kasprzak et al. |
| 4,769,159 | A | * | 9/1988 | Copeland ..... 8/137 |
| 4,818,569 | A | | 4/1989 | Trinh et al. |
| 4,834,895 | A | | 5/1989 | Cook et al. |
| 4,889,643 | A | | 12/1989 | Royce et al. |
| 4,891,890 | A | | 1/1990 | Church |
| 4,906,410 | A | | 3/1990 | Lacke et al. |
| 4,950,412 | A | * | 8/1990 | Duffin et al. ..... 510/516 |
| 4,977,479 | A | | 12/1990 | Caroll |
| 5,020,240 | A | | 6/1991 | Lee |
| 5,041,230 | A | | 8/1991 | Borcher, Sr. et al. |
| 5,069,231 | A | | 12/1991 | Rutherford |
| 5,082,692 | A | | 1/1992 | Cavill |
| 5,102,564 | A | | 4/1992 | Gardlik et al. |
| 5,145,595 | A | | 9/1992 | Morris et al. |
| 5,416,983 | A | | 5/1995 | Moser |
| 5,440,976 | A | | 8/1995 | Guiliano et al. |
| 5,480,567 | A | | 1/1996 | Lam et al. |
| 5,503,756 | A | | 4/1996 | Corona, III et al. |
| 5,658,651 | A | | 8/1997 | Smith et al. |
| 5,726,143 | A | | 3/1998 | Petraia et al. |
| 5,787,606 | A | | 8/1998 | Bokholdt |

(Continued)

FOREIGN PATENT DOCUMENTS

| | | | |
|---|---|---|---|
| CA | 950073 | A | 6/1974 |
| CA | 1016706 | A1 | 9/1977 |
| DE | 2 350 574 | | 10/1973 |
| EP | 0 000 416 | A | 1/1979 |
| EP | 0 154 359 | A1 | 9/1985 |
| EP | 194127 | A2 | 9/1986 |
| EP | 0 258 923 | A2 | 3/1988 |
| EP | 332260 | A2 | 9/1989 |
| EP | 0 539 025 | A2 | 4/1993 |
| FR | 2175098 | A1 | 10/1973 |
| FR | 2475560 | A1 | 8/1981 |
| GB | 1 383 749 | | 10/1971 |
| GB | 1603940 | | 12/1981 |
| GB | 2 164 657 | A | 9/1985 |
| GB | 2212179 | | 7/1989 |

(Continued)

*Primary Examiner*—John R Hardee
(74) *Attorney, Agent, or Firm*—Andrew D. Sorensen; Anneliese S. Mayer; Amy J. Hoffman

(57) ABSTRACT

A fabric softener composition is provided by melt mixing a fabric softener component and a carrier component to provide a fabric softener composition exhibiting a melting point greater than 90° C. The weight ratio of the fabric softener component to the carrier component can be between about 1:19 and about 19:1. Methods for manufacturing the fabric softener composition and using the fabric softener composition to soften fabric while drying laundry in a dryer are provided.

16 Claims, No Drawings

U.S. PATENT DOCUMENTS

| | | | |
|---|---|---|---|
| 5,869,410 | A | 2/1999 | Smith et al. |
| 5,883,069 | A | 3/1999 | Childs et al. |
| 5,943,816 | A | 8/1999 | Hyatt et al. |
| 5,966,831 | A | 10/1999 | Anderson |
| 6,006,472 | A | 12/1999 | Holtkamp, Jr. |
| 6,110,886 | A | 8/2000 | Scepanski |
| 6,133,226 | A | 10/2000 | Knowlton et al. |
| 6,238,736 | B1 | 5/2001 | Smith et al. |
| 6,254,932 | B1 | 7/2001 | Smith et al. |
| 6,305,046 | B1 | 10/2001 | Kingry et al. |
| 6,779,740 | B1 | 8/2004 | Lentsch et al. |
| 2003/0024943 | A1 | 2/2003 | MacDonald |

FOREIGN PATENT DOCUMENTS

| | | | |
|---|---|---|---|
| JP | 53014889 | A | 2/1978 |
| JP | 61232899 | A | 10/1986 |
| JP | 02068100 | A | 3/1990 |
| JP | 03254796 | A | 11/1991 |
| JP | 04002400 | A | 1/1992 |
| JP | 04348799 | A | 12/1992 |
| JP | 07100300 | A | 4/1995 |
| JP | 11164986 | A | 6/1999 |
| WO | WO 98/27191 | | 12/1997 |
| WO | WO 03/087286 | A1 | 10/2003 |

* cited by examiner

FABRIC SOFTENER COMPOSITION AND METHODS FOR MANUFACTURING AND USING

FIELD OF THE INVENTION

The invention relates to a fabric softener composition and to methods for manufacturing and using a fabric softener composition.

BACKGROUND OF THE INVENTION

Several types of dryer fabric softeners have been available. One type of dryer fabric softener is available as a dryer sheet. The dryer sheet is placed in the dryer along with wet laundry. The sheet is often a nonwoven fabric containing a solid composition that includes a fabric softener and a fragrance. During the drying cycle, the temperature increases as the laundry dries, causing the fabric softener to melt and transfer from the nonwoven sheet to the laundry. Dryer sheets are generally provided for a single use. If the dryer sheet becomes entangled with an article of laundry, excessive deposition onto that piece of laundry may result in "spotting." Spotting is the condition where concentrated fabric softener causes a dark spot on a laundry item. For certain dryer sheet products, it is believed that dispensing of the fabric softener is primarily caused by the heat of the dryer melting the fabric softener on the dryer sheet. It is believed that this mostly takes place near the end of the drying cycle when the temperature within the dryer increases.

Dryer sheets containing fabric softeners are described by U.S. Pat. No. 3,442,692 to Gaiser; U.S. Pat. No. 3,686,025 to Morton; U.S. Pat. No. 4,834,895 to Cook et al.; U.S. Pat. No. 5,041,230 to Borcher, Sr. et al.; and U.S. Pat. No. 5,145,595 to Morris et al.

Another type of dryer fabric softener is available as a pouch containing a fabric softener composition. The pouch can be attached to the dryer drum. During the drying cycle, the increase in temperature can melt a portion of the composition inside the pouch. The melted composition then passes through the pouch and transfers to the laundry. The pouch type dryer fabric softener can be available for multiple uses. An example of the pouch type dryer fabric softener was available under the name "Free 'N Soft" from Economics Laboratory of St. Paul, Minn. Examples of pouch type dryer fabric softeners are disclosed by U.S. Pat. No. 3,870,145 to Mizuno; U.S. Pat. No. 3,967,008 to Mizuno et al.; and U.S. Pat. No. 4,098,937 to Mizuno et al.

Additional fabric softener compositions are disclosed by U.S. Pat. No. 3,972,131 to Rudy et al. and U.S. Pat. No. 4,035,307 to Fry et al.

SUMMARY OF THE INVENTION

A fabric softener composition is provided according to the invention. The fabric softener composition includes a result of melt mixing a fabric softener component and a carrier component to provide a fabric softener composition exhibiting a melting point greater than 90° C. The weight ratio of the fabric softener component to the carrier component is between about 1:19 and about 19:1.

A method for manufacturing a fabric softener composition is provided according to the invention. The method includes a step of melt mixing a fabric softener component and a carrier component at a weight ratio of between about 1:19 and about 19:1 to provide a fabric softener composition exhibiting a melting point greater than 90° C. Techniques for melt mixing include extrusion and injection molding.

A method for drying laundry is provided according to the invention. The method includes steps of attaching a fabric softener composition to an inside wall of a dryer, and drying laundry in the dryer in the presence of the fabric softener composition. The fabric softener composition can lose between about 0.01 gram and about 1.0 gram per pound of dry laundry for each drying cycle in the dryer.

DETAILED DESCRIPTION OF THE INVENTION

A fabric softener composition for use in a dryer is provided by the invention. The fabric softener composition can be referred to more simply as the composition, and can be provided in a form that allows it to be made available for multiple uses. By multiple uses, it is meant that the composition can be used to deliver a desired amount of fabric softening to laundry during at least two cycles for drying laundry before it needs to be replaced. It should be understood that the term "laundry" refers to any textile or fabric material that is laundered.

The dryers in which the fabric softener composition according to the invention can be used include any type of dryer that uses heat and agitation to remove water from the laundry. An exemplary dryer includes a tumble-type dryer where the laundry is provided within a rotating drum that causes the laundry to tumble during the operation of the dryer. Tumble-type dryers are commonly found in residences and in commercial and industrial laundry operations.

It is believed that the fabric softener composition according to the invention releases an effective fabric softening amount of the fabric softener component to laundry during a drying cycle in a dryer by a mechanism other than melting the fabric softener composition. It is believed that an effective fabric softening amount of the fabric softener component is transferred to the laundry as a result of contact between the wet laundry and the fabric softener composition in the dryer. The exact mechanism of the transfer is not precisely known, but it is believed that the transfer is likely the result of the wet laundry solubilizing a portion of the fabric softener composition and/or a rubbing off of a portion of the fabric softener composition onto the wet laundry as the wet laundry contacts the fabric softener composition during the tumbling operation in a dryer. As the laundry dries, it is expected that less of the fabric softener component of the fabric softener composition will transfer to the laundry.

The fabric softener composition includes a fabric softener component and a carrier component. The fabric softener component provides fabric softening properties. The fabric softener component can additionally impart antistatic properties to the laundry. The carrier component mixes with the fabric softener component and helps the fabric softener component resist transfer to laundry by melting during the drying operation. The carrier component is chosen so that the fabric softener composition exhibits a melting point or softening point that is above the operating temperature of the dryer. In most dryer operations, this means that the melting temperature of the fabric softener composition is above about 90° C. The melting temperature or the softening temperature of the fabric softener composition can be above about 95° C., above about 100° C., above about 110° C., or above about 120° C. The melting temperature of the fabric softener composition can be below 200° C. The melting temperature of the fabric softener composition refers to the temperature at which the composition begins to flow under its own weight. As the fabric softener composition reaches its melting point, one will observe the composition undergoing a transfer from a solid discreet mass to a flowable liquid. Although a differential scanning calorimeter (DSC) measurement of the composition may reveal that certain portions or phases of the composition may exhibit melting at temperatures that are within the operating temperatures of a dryer, it should be understood that what is meant by the melting temperature of the composition is not the melting temperature of certain portions or phases within the composition, but the melting temperature of the composition as demonstrated by the composition being visibly observed as a flowable liquid. It is expected that the fabric softener composition may be provided as a solid mixture including multiple phases or as a solid solution including a single phase. The softening temperature of the composition refers to the temperature at which the solid mass becomes easily deformable. For many exemplary compositions according to the invention, it is expected that the softening temperature will be a few degrees below the melting temperature.

The fabric softener component can include any component, that when melt mixed with the carrier component to, provides a fabric softener composition exhibiting a desired melting temperature of greater than about 90° C., and that provides fabric softening properties to laundry as a result of its presence in the fabric softener composition when used during the operation of drying wet laundry in a dryer. Exemplary components that can be used as the fabric softener component include those fabric softeners that are commonly used in the laundry drying industry to provide fabric softening properties.

A general type of fabric softener component that can be used according to the invention can be referred to as quaternary ammonium compounds. Exemplary quaternary ammonium compounds include alkylated quaternary ammonium compounds, ring or cyclic quaternary ammonium compounds, aromatic quaternary ammonium compounds, diquaternary ammonium compounds, alkoxylated quaternary ammonium compounds, amidoamine quaternary ammonium compounds, ester quaternary ammonium compounds, and mixtures thereof.

Exemplary alkylated quaternary ammonium compounds include ammonium compounds having an alkyl group containing between 6 and 24 carbon atoms. Exemplary alkylated quaternary ammonium compounds include monoalkyl trimethyl quaternary ammonium compounds, monomethyl trialkyl quaternary ammonium compounds, and dialkyl dimethyl quaternary ammonium compounds. Examples of the alkylated quaternary ammonium compounds are available commercially under the names Adogen™, Arosurf®, Variquat®, and Varisoft®. The alkyl group can be a $C_8$-$C_{22}$ group or a $C_8$-$C_{18}$ group or a $C_{12}$-$C_{22}$ group that is aliphatic and saturated or unsaturated or straight or branched, an allyl group, a benzyl group, an alkyl ether propyl group, hydrogenated-tallow group, coco group, stearyl group, palmityl group, and soya group. Exemplary ring or cyclic quaternary ammonium compounds include imidazolinium quaternary ammonium compounds and are available under the name Varisoft®. Exemplary imidazolinium quaternary ammonium compounds include methyl-1hydr. tallow amido ethyl-2-hydr. tallow imidazolinium-methyl sulfate, methyl-1-tallow amido ethyl-2-tallow imidazolinium-methyl sulfate, methyl-1-oleyl amido ethyl-2-oleyl imidazolinium-methyl sulfate, and 1-ethylene bis (2-tallow, 1-methyl, imidazolinium-methyl sulfate). Exemplary aromatic quaternary ammonium compounds include those compounds that have at least one benzene ring in the structure. Exemplary aromatic quaternary ammonium compounds include dimethyl alkyl benzyl quaternary ammonium compounds, monomethyl dialkyl benzyl quaternary ammonium compounds, trimethyl benzyl quaternary ammonium compounds, and trialkyl benzyl quaternary ammonium compounds. The alkyl group can contain between about 6 and about 24 carbon atoms, and can contain between about 10 and about 18 carbon atoms, and can be a stearyl group or a hydrogenated tallow group. Exemplary aromatic quaternary ammonium compounds are available under the names Variquat® and Varisoft®. The aromatic quaternary ammonium compounds can include multiple benzyl groups. Diquaternary ammonium compounds include those compounds that have at least two quaternary ammonium groups. An exemplary diquaternary ammonium compound is N-tallow pentamethyl propane diammonium dichloride and is available under the name Adogen 477. Exemplary alkoxylated quaternary ammonium compounds include methyldialkoxy alkyl quaternary ammonium compounds, trialkoxy alkyl quaternary ammonium compounds, trialkoxy methyl quaternary ammonium compounds, dimethyl alkoxy alkyl quaternary ammonium compounds, and trimethyl alkoxy quaternary ammonium compounds. The alkyl group can contain between about 6 and about 24 carbon atoms and the alkoxy groups can contain between about 1 and about 50 alkoxy groups units wherein each alkoxy unit contains between about 2 and about 3 carbon atoms. Exemplary alkoxylated quaternary ammonium compounds are available under the names Variquat®, Varstat®, and Variquat®. Exemplary amidoamine quaternary ammonium compounds include diamidoamine quaternary ammonium compounds. Exemplary diamidoamine quaternary ammonium compounds are available under the name Varisoft®. Exemplary amidoamine quaternary ammonium compounds that can be used according to the invention are methyl-bis(tallow amidoethyl)-2-hydroxyethyl ammonium methyl sulfate, methyl bis (oleylamidoethyl)-2-hydroxyethyl ammonium methyl sulfate, and methyl bis (hydr.tallowamidoethyl)-2-hydroxyethyl ammonium methyl sulfate. Exemplary ester quaternary compounds are available under the name Stephantex™.

The quaternary ammonium compounds can include any counter ion that allows the component to be used in a manner that imparts fabric-softening properties according to the invention. Exemplary counter ions include chloride, methyl sulfate, ethyl sulfate, and sulfate.

Quaternary ammonium compounds that can be used as fabric softener components can be available as relatively pure or concentrated quaternary ammonium compounds or they can be provided in a medium. Exemplary mediums include solvents and/or surfactants. When the quaternary ammonium compounds are provided in a medium, they can be provided in the medium in an amount of between at least about 50 wt. %, or between about 50 wt. % and about 99 wt. %, or between about 70 wt. % and about 95 wt. %, or between about 75 wt. % and about 90 wt. %. Exemplary mediums for the quaternary ammonium compounds include alcohols, glycols, nonionics, fatty alcohols, fatty acids, triglycerides, and solid esters. An exemplary alcohol that can be used is isopropanol. Exemplary glycols that can be used include hexylene glycol and propylene glycol. Exemplary nonionics include ethoxylated alcohols. Exemplary fatty alcohols include stearyl alcohols. Exemplary fatty acids include hard tallow acids and stearic acid. Exemplary triglycerides include hydrogenated tallow. Exemplary solid esters include stearyl stearate.

The carrier component of the fabric softener composition can be any component that helps contain the fabric softener component within the composition, allows the fabric softener component to transfer to wet laundry, and provides the fabric softener composition with a melting temperature or a softening temperature that is greater than the operating temperature of the dryer. Exemplary carrier components that can be used according to the invention include ethylene bisamides, primary alkylamides, alkanolamides, polyamides, alcohols containing at least 12 carbon atoms, alkoxylated alcohols containing alkyl chain of at least 12 carbon atoms, carboxylic acids containing at least 12 carbon atoms, and derivatives thereof. Exemplary ethylene bisamides include those having the following formula:

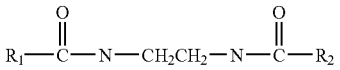

wherein $R_1$ and $R_2$ are alkyl groups containing at least 6 carbon atoms, and can be straight or branched, saturated or unsaturated, cyclic or noncyclic, and can include ethylene oxide groups and/or propylene oxide groups. $R_1$ and $R_2$ can be $C_6$-$C_{24}$ alkyl groups. $R_1$ and $R_2$ can be the same or different. Exemplary ethylene bisamides include ethylene bisteramide, ethylene bisoleamide, and ethylene bisbehenamide. Exemplary primary alkylamides include those having the following formula:

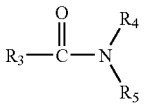

wherein $R_3$ is a $C_6$-$C_{24}$ alkyl group that may be straight or branched, saturated or unsaturated, cyclic or noncyclic, and $R_4$ and $R_5$ can be hydrogen or $C_1$-$C_{24}$ alkyl groups that are straight or branched, saturated or unsaturated, cyclic or noncyclic. $R_4$ and $R_5$ can be the same or different. An exemplary primary alkylamide is stearamide. Exemplary alkanolamides include those having the following formula:

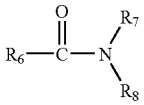

Wherein $R_6$ is a $C_6$-$C_{24}$ alkyl group that may be straight or branched, saturated or unsaturated, cyclic or noncyclic. $R_7$ and $R_8$ can be the same or different. When they are different, one can be hydrogen and the other can be an alkanol group such as $C_2H_4OH$ or $C_3H_6OH$. When they are the same, they can each be an alkanol group such as $C_2H_4OH$ or $C_3H_6OH$. Exemplary alcohols include those having the following formula:

$$R_9—OH$$

wherein $R_9$ is a $C_{12}$ to $C_{24}$ alkyl group that can be straight or branched, saturated or unsaturated, cyclic or noncyclic. Exemplary alcohols include stearyl alcohol and behenyl alcohol. Exemplary alkoxylated alcohols include those having the formula:

$$R_{10}—O(AO)_x$$

wherein $R_{10}$ is a $C_{12}$-$C_{24}$ alkyl group that is straight or branched, saturated or unsaturated, cyclic or noncyclic, and AO is an ethylene oxide or propylene oxide group, and x is a number from 1 to 100.

Additional components that can be included in the fabric softener composition include plasticizers and fragrances.

The fabric softener composition can be prepared by mixing the fabric softener component and the carrier component and any additional desired components at a temperature sufficient to melt all the components. The step of mixing preferably takes place at a temperature in excess of about 100° C. In general, the components should not be mixed at a temperature that is so high that it harms or discolors the components of the composition. For many components of the fabric softener composition, the mixing temperature can be less that about 180° C. An exemplary range for mixing is between about 120° C. and about 150° C. Once the components are sufficiently mixed, the composition is shaped to provide a desired form. The form can be provided as a solid unitary structure. Exemplary forms include blocks or strips that can be placed within a drying machine so that a surface of the fabric softener composition is exposed to laundry during the drying operation. Exemplary forms include a rectangular block and a rectangular strip. Additional forms include half-cylindrical shapes with the exposed surfaces and edges being curved or rounded for better dispensing. The fabric softener composition can be provided having a size of at least about 5 grams. When the fabric softener composition is provided having a size of at least about 5 grams, it is expected that it will provide fabric softening and/or antistatic properties for laundry in multiple cycles of a dryer. An exemplary size is about 30 g to about 170 g.

The fabric softener component and the carrier component can be mixed together to provide a fabric softener composition that releases a desired amount of fabric softener component during the drying cycle when placed inside of a dryer. An exemplary weight ratio of fabric softener component to carrier component is between about 1:19 to about 19:1. The ratio of the fabric softener component to the carrier component can be between about 1:10 and about 10:1, and can be between about 3:7 and about 9:1. It should be understood that the reference to the fabric softener component refers to the component responsible for providing fabric-softening properties, and is not meant to include the medium that may be present with the fabric softener component. That is, the fabric softener component may be commercially available in a medium that can be a solvent or a surfactant. Furthermore, the medium can be the same as or different from the carrier component.

The fabric softener composition can be attached to the inside of a dryer. The fabric softener composition can be attached on a dryer fin of a tumble dryer so that the composition contacts the wet laundry during the drying operation. It is believed that the contact between the wet laundry and the formed composition causes a transfer of the fabric softener component to the wet laundry. It is believed that the composition can be attached to the inside of the dryer by a cradle such as the cradle disclosed by U.S. Pat. No. 6,883,723,the entire disclosure of which is incorporated herein by reference in its entirety.

During the drying cycle, the fabric softener composition should release a sufficient amount of the fabric softener composition to provide a desired level of softening properties and, if desired, antistatic properties. In addition, the fabric softener composition should not release too much of the fabric softener component that would result in spotting of the laundry. It is expected that during the drying cycle, the fabric softener composition will lose between about 0.01 to about 1.0 gram of the fabric softener composition per pound of dry laundry. The amount of loss per drying cycle can be between about 0.02 to 0.75 gram of the fabric softener composition per pound of dry laundry, and can be between about 0.05 to 0.50 gram of fabric softener composition per pound of dry laundry. In the situation where a dryer that is rated for a 30 pound capacity is used to dry laundry, the dry weight of the laundry is typically about 15 pounds. In this situation, a block of fabric softener composition having a size of about 150 grams is expected to lose about 1.5 grams per drying cycle and provide softening for 100 cycles. It should be understood that the size of the dryer and the size of the fabric softener composition can vary for different types of dryers and drying conditions. For example, there are various sizes of dryers that are commonly used in industrial laundry facilities and in residential or consumer environments.

EXAMPLE 1

Seventeen fabric softener compositions for use in a dryer and providing antistatic and softening properties are presented in Table 1. The compositions are provided as solids exhibiting a melting point above 100° C.

TABLE 1

| | | Fabric Softener Compositions | | | | | | | | | | | | | | | |
|---|---|---|---|---|---|---|---|---|---|---|---|---|---|---|---|---|---|
| Trade Name | Chemical Name | 1 | 2 | 3 | 4 | 5 | 6 | 7 | 8 | 10 | 11 | 12 | 13 | 14 | 15 | 16 | 17 |
| Arosurf TA 100 | Distearyl dimethyl ammonium chloride, 95%; propylene glycol, 5% | 50.0 | 60.0 | 70.0 | 77.0 | 67.0 | 57.0 | 60.5 | 55.5 | 45.5 | 40.5 | 47.5 | 46.5 | | | 28.0 | |
| Arosurf TA 101 | Distearyl dimethyl ammonium chloride, 100% | | | | | | | | | | | | | 30.0 | 25.0 | | |
| Acrawax C | Ethylene bistearamide | 50.0 | 40.0 | 30.0 | 20.0 | | 15.0 | 35.0 | 30.0 | 50.0 | 55.0 | 52.5 | 51.5 | 45.0 | 45.0 | 45.0 | 55.0 |
| Witco Wax | Stearic monoethanolamide | | | | | 30.0 | 25.0 | | 10.0 | | | | | | | | |
| Tipinol CBS-S | Distyryl biphenyl derivative (optical brightener) | | | | 2.5 | 2.5 | 2.5 | 2.5 | 2.5 | 2.5 | 2.5 | | | | | | |
| Fresh n Clean | Fragrance | | | | 0.5 | 0.5 | 0.5 | 2.0 | 2.0 | 2.0 | 2.0 | | | | | | |
| Hamposyl M-95 | Sodium myristoyl sarcosinate, 95% | | | | | | | | | | | | 2.0 | | | | |
| Finquat CT | Quaternium 75 (a cationic quaternary ammonium ethosulfate) | | | | | | | | | | | | | 2.0 | 5.0 | 2.0 | |
| Varisoft DS-100 | Dihydrogenated tallow dimethyl ammonium methyl sulfate, 70%; nonionic surfactant, 30% | | | | | | | | | | | | | 23.0 | | | |
| Varisoft 136-100 | Dihydrogenated tallow dimethyl ammonium methyl sulfate, 70%; alcohol ethoxylate, 30% | | | | | | | | | | | | | | 25.0 | | |
| Varisoft 110-75% | Methyl bis-(hydrogenated tallow amidoethyl) 2-hydroxyethyl ammonium methyl sulfate, 75%; Isopropanol, 25% | | | | | | | | | | | | | | | 25.0 | 45.0 |
| TOTAL | | 100.0 | 100.0 | 100.0 | 100.0 | 100.0 | 100.0 | 100.0 | 100.0 | 100.0 | 100.0 | 100.0 | 100.0 | 100.0 | 100.0 | 100.0 | 100.0 |
| Melting Point (C.) | | | | | | | | | | | | | | 120-125 | | 127 | 125-130 |
| Wt Loss/cycle | | | | | | 7.24 | >26.00 | 6.72 | 8 | 4.74 | 2.13 | | | 6.57 | | | |

Preliminary dispensing rates of some of the fabric softening compositions of Table 1 were obtained and shown at the bottom of the table. In each test, the fabric softening composition is coated on a plastic carrier which is then locked into place on a dispenser adhered on the dryer fin. Average dispensing rate was obtained by weight difference after multiple standard wash and dry cycles with 30 lb. dry weight terry towels.

A desired amount of the fabric softening composition to provide fabric softening properties can be released during the drying cycle. In this example, dispensing of the product was measured by weight loss. Approximate dosage requirements for the solid fabric softener were developed based on comparisons to current liquid softeners. Current liquid softeners deliver between 75-150 ppm of softening agent per cycle. For example, a liquid laundry softener with 6% active softening agent with a dose recommendation at 2-3 oz/100 wt. (100 lb. dry weight linen in the wash mashine) would deliver the following ppm active softening agent:

$$0.06 \text{ active softening agent} \times \frac{(2-3 \text{ oz}) \times 28.35 \text{ g} \times 1{,}000{,}000}{100 \text{ lbs} \times 454 \text{ g/lbs}} = 75-112 \text{ ppm}$$

For comparison, a target solid fabric softening composition with 45% active softening component and a dispensing rate of 4 grams per cycle in the dryer will deliver the following ppm active softening agent:

$$\frac{0.45 \text{ active} \times (4 \text{ grams}) \times 1{,}000{,}000}{30 \text{ lbs} \times 454 \text{ g/lbs}} = 132 \text{ ppm}$$

Referring to Table 1, composition 10 meets these criteria.

Composition 10 was further tested by running a twenty cycle test to test for yellowing and softening. For the test, a liquid detergent containing no optical brightener was used for the wash cycles. To test for whiteness retention, eight new white terry towels were read on the Hunter Lab Instrument prior to testing for whiteness index (WI) and yellowing index (YI). After 10, 15 and 20 cycles, towels were removed and reread on the Hunter Lab Instrument for WI and YI numbers. The results of the twenty-cycle test show the fabric softener composition had an average dose of 4.19 grams per cycle (Table 2). All of the towels after twenty cycles had a yellow-green appearance, noticeable in the large drop in WI and YI (Table 3).

TABLE 2

Dispensing data for dryer strip of Composition 10

| Cycle # | wt. Initial | wt. Final | wt. Loss | Comments |
|---|---|---|---|---|
| 1 | 74.69 | 70.79 | 3.90 | Start with new strip. |
| 2 | 65.59 | 57.59 | 8.00 | |
| 3 | 91.82 | 85.22 | 6.60 | Replace with new strip. |
| 4 | 85.22 | 79.17 | 6.05 | |
| 5 | 79.17 | 74.96 | 4.21 | |
| 6 | 74.96 | 70.73 | 4.23 | |
| 7 | 70.73 | 66.9 | 3.83 | |
| 8 | 66.9 | 62.28 | 4.62 | |
| 9 | 62.28 | 57.35 | 4.93 | |
| 10 | 57.35 | 52.98 | 4.37 | |
| 11 | 52.98 | 50.62 | 2.36 | |
| 12 | 50.62 | 47.91 | 2.71 | |
| 13 | 106.85 | 101.33 | 5.52 | Replace with new strip. |
| 14 | 101.33 | 96.78 | 4.55 | |
| 15 | 96.78 | 92.48 | 4.30 | |
| 16 | 92.48 | 89.46 | 3.02 | |
| 17 | 89.46 | 86.87 | 2.59 | |
| 18 | 86.87 | 84.59 | 2.28 | |
| 19 | 84.59 | 81.42 | 3.17 | |
| 20 | 74.69 | 72.09 | 2.60 | Replace with new strip. |
| Average | | | 4.19 | |

The average ppm active softening agent delivered by Composition 10 in the dryer per drying cycle can be calculated as:

$$\frac{(0.455 \times 0.95)\text{active} \times (4.19 \text{ grams}) \times 1{,}000{,}000}{30 \text{ lbs} \times 454 \text{ g/lbs}} = 133 \text{ ppm}$$

TABLE 3

Whiteness Retention Results

| Towel ID | # of cycles | L* before | YI initial | WI initial | L* final | YI final | WI final | delta YI | delta WI | Whiteness Retention (%) |
|---|---|---|---|---|---|---|---|---|---|---|
| L | 10 | 96.12 | 4.91 | 72.74 | 95.77 | 5.01 | 71.68 | −0.1 | 1.06 | 98.54 |
| N | 10 | 96.12 | 5.87 | 69.28 | 95.52 | 5.60 | 69.13 | 0.27 | 0.15 | 99.78 |
| J | 15 | 96.58 | 3.26 | 79.57 | 95.28 | 5.92 | 67.55 | −2.66 | 12.02 | 84.89 |
| K | 15 | 96.07 | 2.58 | 80.95 | 94.97 | 6.68 | 64.33 | −4.1 | 16.62 | 79.47 |
| I | 20 | 97.13 | 3.25 | 80.79 | 94.29 | 8.05 | 58.46 | −4.8 | 22.33 | 72.36 |
| O | 20 | 96.37 | 3.97 | 76.67 | 94.38 | 8.52 | 56.54 | −4.55 | 20.13 | 73.75 |
| M | 20 | 96.18 | 4.79 | 73.26 | 94.13 | 8.63 | 56.23 | −3.84 | 17.03 | 76.75 |
| P | 20 | 96.37 | 4.11 | 76.10 | 94.33 | 9.13 | 54.82 | −5.02 | 21.28 | 72.04 |

EXAMPLE 2

Composition 17 in Table 1 uses a fabric softener component that can be considered non-yellowing. The fabric softener component is available under the name Varisoft 110-75% and includes 75% methyl bis-(hydrogenated tallow amidoethyl)-2-hydroxyethyl ammonium methyl sulfate, and 25% isopropanol. It is believed that during the melt mixing and casting of fabric softening composition 17, most, if not all, of the isopropanol flashed off. The twenty-cycle test was repeated with composition 17. Fifteen pounds of dry terry towel were used in this test, and WI and YI readings were taken before and after twenty cycles. The average weight loss with this formulation was 0.976 grams/cycle. This calculates to be approximately 54.5 ppm of active fabric softener component per cycle.

Calculation:

$$\frac{(0.45\times0.75)/(0.45\times0.75+0.55)\ \text{active softening component}\times(0.976\ \text{grams})\times1{,}000{,}000}{15\ \text{lbs}\times454\ \text{g/lbs}}=54.5\ \text{ppm}$$

TABLE 4

Dispensing data for Composition 17; 20 cycle test with Composition 17 used in the dryer for the drying cycles; 70 grams of a commercial liquid detergent without optical brightener used in the wash cycles

| Cycle | Initial Wt. | Final Wt | Wt. Loss |
|---|---|---|---|
| 1 | 48.85 | 47.71 | 1.14 |
| 2 | 54.21 | 52.72 | 1.49 |
| 3 | 52.72 | 51.20 | 1.52 |
| 4 | 51.20 | 50.00 | 1.20 |
| 5 | 50.00 | 49.02 | 0.98 |
| 6 | 49.02 | 47.97 | 1.05 |
| 7 | 47.97 | 47.06 | 0.91 |
| 8 | 71.74 | 70.18 | 1.56 |
| 9 | 70.18 | 68.67 | 1.51 |
| 10 | 94.28 | | |
| 20 | | 86.12 | 8.16 |
| Average over all 20 cycles | | | 0.976 |

TABLE 5

Whiteness retention results with the use of dryer fabric softening composition Composition 17

| Towel ID | # of cycles | L* before | YI initial | WI initial | L* final | YI final | WI final | delta YI | delta WI | Whiteness Retention (%) |
|---|---|---|---|---|---|---|---|---|---|---|
| 10 | 10 | 96.37 | 4.11 | 76.10 | 95.86 | 4.41 | 73.99 | −0.3 | 2.11 | 97.23 |
| 15 | 15 | 97.13 | 3.25 | 80.79 | 95.97 | 3.55 | 77.25 | −0.3 | 3.54 | 95.62 |
| 20 | 20 | 96.18 | 4.79 | 75.34 | 95.09 | 4.82 | 71.03 | −0.03 | 4.31 | 94.28 |

EXAMPLE 3

Additional fabric softening compositions are identified in Table 6. Composition 23 includes a non-yellowing fabric softener component available under the name Varisoft DS-110, and includes 70% methyl bis(hydrogenated tallow amidoethyl)-2-hydroxyethyl ammonium methyl sulfate, and 30% alcohol ethoxylate. The fabric softening quaternary ammonium compound was manufactured in a medium of alcohol ethoxylate.

Composition 23 was tested in a 20-cycle (wash and dry) test. Fifteen pounds of dry terry towel was used for this test. Results are shown in Tables 7 and 8. After twenty cycles, the average dispensing rate per cycle was 2.62 grams, delivering an average of 130 ppm active softening component.

TABLE 6

Fabric Softening Composition

| Trade Name | Chemical Structure | 17 | 18 | 19 | 20 | 21 | 22 | 23 |
|---|---|---|---|---|---|---|---|---|
| Acrawax C | Ethylene bistearamide | 55.0 | 40.0 | 40.0 | 50.0 | 52.5 | 51.5 | 51.5 |
| Finquat CT | Quaternium 75 (a cationic quaternary ammonium ethosulfate) | | | 5.0 | | | | |

TABLE 6-continued

| Trade Name | Chemical Structure | Fabric Softening Composition 17 | 18 | 19 | 20 | 21 | 22 | 23 |
|---|---|---|---|---|---|---|---|---|
| Varisoft 110 75% | Methyl bis-(hydrogenated tallow amidoethyl) 2-hydroxyethyl ammonium methyl sulfate, 75%; Isopropanol, 25% | 45.0 | 60.0 | 50.0 | 50.0 | 47.5 | 48.5 | |
| Abil Quat 3272 | Quaternium 80 | | | 5.0 | | | | |
| Varisoft DS-110 | Methyl bis-(hydrogenated tallow amidoethyl) 2-hydroxyethyl ammonium methyl sulfate, 70%; alcohol ethoxylate, 30% | | | | | | | 48.5 |
| TOTAL | | 100.0 | 100.0 | 100.0 | 100.0 | 100.0 | 100.0 | 100.0 |
| Melting Point (C) | | 125-130 | | | | | | |
| Wt Loss/cycle | | 1.04 | 3.99 | | 2.83 | 2.22 | 1.82 | 2.62 |
| length | | 8.5" | 8¾" | | | 8.5" | 8.5" | 8.5" |

TABLE 7

Whiteness retention results with the use of dryer fabric softening composition Composition 23

| cycles | delta WI | delta YI | Whiteness Retention (%) |
|---|---|---|---|
| 8 | 1.08 | 0.13 | 98.58 |
| 15 | 1.42 | 0.04 | 98.24 |
| 20 | 4.53 | 0.34 | 93.99 |

TABLE 8

Dispensing data for Composition 23

| cycle | wt | wt final | wt loss/cycle |
|---|---|---|---|
| 1 | 95.82 | | |
| 2 | | | |
| 3 | | | |
| 4 | | 79.13 | 4.1725 |
| 5 | 70.7 | | |
| 6 | | | |
| 7 | | | |
| 8 | | 66.75 | 0.9875 |
| 9 | | | 3.5 |
| 10 | 81.84 | 78.93 | 2.91 |
| 11 | | | |
| 12 | | | |
| 13 | | | |
| 14 | | | |
| 15 | 78.93 | 69.1 | 1.966 |
| 16 | broke | | |
| 17 | 64.42 | | |
| 18 | 61.77 | | |
| 19 | | | |
| 20 | | 55.18 | 2.197 |
| Average | | | 2.62 |

Calculations $$\frac{0.485 \text{ softener component} \times (0.70 \text{ active}) \times (2.62 \text{ grams}) \times 1{,}000{,}000}{15 \text{ lbs} \times 454 \text{ g/lbs}} = 130 \text{ ppm}$$

EXAMPLE 4

The following example was conducted to evaluate the antistatic properties of the fabric softener composition according to the invention. The antistatic properties were determined by measuring electrical charge in units of coulombs using an electrometer model 610C from Keithley Instruments. The electric charge was measured between a first cylinder having a size of 20 gallons provided within a second cylinder having a size of 31 gallons. Terry cloth towels were removed from the dryer and placed, one at a time, into the 20 gallon cylinder and the electric charge between the two cylinders was measured.

The results of this example are reported in the following tables wherein each table represents a side-by-side comparison between a drying operation in the presence of composition 23, and a second operation in the absence of a fabric softening composition. In each operation, 15 lb dry weight basis terry cloth towels were used. The results are reported in the following tables.

TABLE 9

| | | | | | | | | | | | |
|---|---|---|---|---|---|---|---|---|---|---|---|
| | Items dried | | terry towels | | Items dried | | terry towels | | Items dried | | terry towels |
| | Dryer time | | 45 mins | | Dryer time | | 45 mins | | Dryer time | | 45 mins |
| | Ambient temp | | 80.2 | | Ambient temp | | 79.2 | | Ambient temp | | 82.4 |
| | Humidity | | 24% | | Humidity | | 21% | | Humidity | | 19% |
| | Composition | | No | | Composition | | No | | Composition | | No |
| | 23 | | Composition | | 23 | | Composition | | 23 | | Composition |
| − | 1.80E−08 | + | 7.00E−08 | − | 4.50E−08 | | 8.00E−09 | | 1.00E−07 | | 1.20E−08 |
| − | 6.00E−09 | + | 5.00E−08 | − | 1.90E−08 | | 1.20E−98 | | 4.60E−08 | | 1.40E−08 |
| − | 6.00E−09 | + | 5.00E−08 | − | 7.00E−09 | | 1.50E−08 | | 7.00E−08 | | 3.00E−08 |
| − | 1.40E−08 | + | 6.00E−08 | + | 4.00E−09 | | 1.60E−08 | | 2.50E−08 | | 4.00E−08 |
| − | 1.00E−08 | + | 1.15E−07 | − | 3.40E−08 | | 2.80E−08 | | 4.00E−08 | | 9.00E−08 |
| − | 4.00E−09 | + | 4.50E−08 | | 1.10E−08 | | 7.00E−09 | | 3.80E−08 | | 5.00E−08 |
| + | 2.00E−08 | + | 8.00E−08 | − | 1.90E−08 | | 7.50E−08 | | 2.60E−08 | | 1.20E−07 |
| + | 3.00E−09 | + | 1.50E−07 | − | 1.00E−08 | | 8.00E−08 | | 1.00E−08 | | 1.00E−07 |
| + | 2.00E−09 | + | 6.50E−08 | − | 6.00E−09 | | 6.00E−08 | | 8.00E−09 | | 1.60E−07 |
| + | 3.00E−09 | + | 7.00E−08 | − | 4.00E−09 | | 1.10E−07 | | 1.20E−08 | | 2.00E−07 |
| | | + | 1.40E−07 | + | 2.00E−09 | | 1.40E−07 | | 4.60E−08 | | 1.00E−07 |
| | | + | 1.10E−07 | | | | 9.00E−08 | | 2.40E−08 | | 1.40E−07 |
| Ave | 8.60E−09 | Ave | 8.38E−08 | Ave | 1.46E−08 | Ave | 5.34E−08 | Ave | 3.71E−08 | Ave | 8.80E−08 |
| SD | 6.59E−09 | SD | 3.61E−08 | SD | 1.37E−08 | SD | 4.54E−08 | SD | 2.67291E−08 | SD | 6.03866E−08 |
| | % Reduction | | 89.73 | | % Reduction | | 72.60 | | % Reduction | | 57.86 |
| | Wt initial | | 163.82 | | Wt initial | | 157.71 | | Wt initial | | 153.58 |
| | Wt final | | 157.71 | | Wt final | | 153.58 | | Wt final | | 149 |
| | difference | | 6.11/15 | | difference | | 4.13 | | difference | | 4.58 |
| | | | lb dry weight | | | | | | | | |

Target = 1.50 g/15 lb.

TABLE 10

| | | | | | | | | | | | |
|---|---|---|---|---|---|---|---|---|---|---|---|
| | Items dried | | terry towels | | Items dried | | terry towels | | Items dried | | terry towels |
| | Dryer time | | 45 mins | | Dryer time | | 45 mins | | Dryer time | | 45 mins |
| | Ambient temp | | 80.2 | | Ambient temp | | 81.6 | | Ambient temp | | 79.7 |
| | Humidity | | 25% | | Humidity | | 25% | | Humidity | | 24% |
| | Composition | | No | | Composition | | No | | Composition | | No |
| | 23 | | Composition | | 23 | | Composition | | 23 | | Composition |
| | 3.00E−08 | | 6.00E−08 | | 2.20E−08 | | 1.00E−08 | | 4.00E−09 | | 2.20E−08 |
| | 7.00E−08 | | 1.00E−07 | | 2.40E−08 | | 2.20E−08 | | 4.00E−09 | | 3.20E−08 |
| | 1.20E−08 | | 1.00E−07 | | 2.00E−08 | | 4.00E−08 | | 1.60E−08 | | 4.40E−08 |
| | 1.20E−08 | | 3.00E−08 | | 1.00E−08 | | 5.00E−08 | | 4.00E−09 | | 5.00E−08 |
| | 4.60E−08 | | 4.00E−08 | | 8.00E−09 | | 2.00E−08 | | 2.20E−08 | | 3.00E−08 |
| | 4.00E−08 | | 1.80E−08 | | 2.00E−09 | | 3.40E−08 | | 1.00E−08 | | 1.80E−08 |
| | 3.50E−08 | | 1.20E−07 | | 1.20E−08 | | 1.20E−08 | | 6.00E−09 | | 3.00E−08 |
| | 5.00E−08 | | 4.40E−08 | | 4.00E−09 | | 1.20E−08 | | 1.20E−08 | | 3.80E−08 |
| | 2.40E−08 | | 7.00E−08 | | 1.00E−08 | | 1.80E−08 | | 1.80E−08 | | 3.00E−08 |
| | 4.60E−08 | | 8.00E−08 | | 1.20E−08 | | 8.50E−08 | | 1.80E−08 | | 2.00E−08 |
| | 8.00E−08 | | 1.00E−07 | | 1.00E−08 | | 9.00E−08 | | 1.00E−08 | | 3.00E−08 |
| | 7.00E−08 | | | | | | 6.00E−08 | | | | |
| Ave | 4.29E−08 | Ave | 6.93E−08 | Ave | 1.22E−08 | Ave | 3.78E−08 | Ave | 1.13E−08 | Ave | 3.13E−08 |
| SD | 2.22E−08 | SD | 3.36E−08 | SD | 7.07E−09 | SD | 2.81E−08 | SD | 6.4667E−09 | SD | 9.76822E−09 |
| | % Reduction | | 38.05 | | % Reduction | | 67.73 | | % Reduction | | 63.95 |
| | Wt initial | | 82.02 | | Wt initial | | 79.91 | | Wt initial | | 77.66 |
| | Wt final | | 79.91 | | Wt final | | 77.96 | | Wt final | | 76.90 |
| | difference | | 2.11 g | | difference | | 1.95 g | | difference | | 0.76 g |

TABLE 11

| | | | | | |
|---|---|---|---|---|---|
| Items dried | terry towels | Items dried | terry towels | Items dried | terry towels |
| Dryer time | 45 mins | Dryer time | 45 mins | Dryer time | 45 mins |
| Ambient temp | 77 | Ambient temp | 77.1 | Ambient temp | 77.3 |
| Humidity | 21% | Humidity | 21% | Humidity | 21% |
| Composition | No | Composition | No | Composition | No |
| 23 | Composition | 23 | Composition | 23 | Composition |
| 3.00E−07 | 5.80E−08 | 2.20E−07 | 2.40E−07 | 1.40E−07 | 1.20E−07 |
| 1.00E−07 | 2.60E−07 | 2.00E−07 | 2.60E−07 | 3.00E−07 | 1.00E−07 |
| 3.60E−07 | 2.00E−07 | 2.40E−07 | 8.00E−08 | 1.20E−07 | 6.00E−07 |
| 1.40E−07 | 3.00E−07 | 1.40E−07 | 1.00E−07 | 2.20E−07 | 1.40E−07 |
| 1.40E−07 | 2.50E−07 | 1.20E−07 | 6.00E−07 | 1.00E−07 | 1.00E−07 |
| 2.40E−07 | 5.50E−07 | 1.60E−07 | 1.00E−07 | 1.00E−07 | 1.40E−07 |
| 2.40E−07 | 3.50E−07 | 1.40E−07 | 4.00E−07 | 1.40E−07 | 7.00E−08 |
| 2.00E−07 | 1.80E−07 | 1.40E−07 | 1.20E−07 | 1.80E−07 | 1.00E−07 |
| 3.40E−07 | 3.20E−07 | 2.00E−07 | 8.00E−08 | 1.40E−07 | 4.00E−08 |

TABLE 11-continued

| | | | | | | | | | | | |
|---|---|---|---|---|---|---|---|---|---|---|---|
| | 2.50E−07 | | 1.60E−07 | | 1.40E−07 | | | | 2.40E−08 | | 4.20E−07 |
| | 2.00E−07 | | 2.20E−07 | | 8.00E−08 | | | | 8.00E−08 | | 1.20E−07 |
| | | | | | | | | | 1.00E−07 | | |
| Ave | 2.28E−07 | Ave | 2.59E−07 | Ave | 1.62E−07 | Ave | 2.20E−07 | Ave | 1.37E−07 | Ave | 1.77E−07 |
| SD | 8.33E−08 | SD | 1.26E−07 | SD | 4.77E−08 | SD | 1.79E−07 | SD | 7.4658E−08 | SD | 1.71819E−07 |
| | % Reduction | | 11.87 | | % Reduction | | 26.45 | | % Reduction | | 22.87 |
| | Wt initial | | 48.75 | | Wt initial | | 47.04 | | Wt initial | | 45.88 |
| | Wt final | | 47.04 | | Wt final | | 45.88 | | Wt final | | 44.66 |
| | difference | | 1.71 g | | difference | | 1.16 g | | difference | | 1.22 g |

EXAMPLE 5

Another composition of this invention is represented by a composition identical to composition 23 except that the same active non-yellowing fabric softening quaternary ammonium component was manufactured in a medium of stearyl alcohol instead of alcohol ethoxylate. This composition provided desirable (high) melting temperature, dispensing, and softening characteristics similar to that of composition 23.

EXAMPLE 6

Another quaternary ammonium component of this invention is represented by a composition identical to composition 23 except that the same active non-yellowing fabric softening quat was manufactured in a medium of behenyl alcohol instead of alcohol ethoxylate. This composition also provided desirable (high) melting temperature, dispensing, and softening characteristics similar to that of composition 23.

Examples 3, 5, and 6 illustrate that the active fabric-softening ingredient can be manufactured in a medium that fits the characteristics of a carrier component. Thus, in one embodiment of this invention, the medium can be chosen such that the manufactured fabric-softener component serves the dual purposes of the fabric softening and carrier and becomes a composition of this invention.

The above specification, examples and data provide a complete description of the manufacture and use of the composition of the invention. Since many embodiments of the invention can be made without departing from the spirit and scope of the invention, the invention resides in the claims hereinafter appended.

The invention claimed is:

1. A method for using a fabric softener composition, the method comprising steps of:

(a) attaching a fabric softener composition to an inside wall of a dryer, wherein the fabric softener composition comprises a result of melt mixing and molding a fabric softener component and a carrier component at a weight ratio of the fabric softener component to the carrier component of between about 1:19 and about 19:1 to provide a fabric softener composition exhibiting a melting point greater than 90° C., wherein the fabric softener component provides fabric softening properties to laundry during a drying operation of wet laundry in a dryer, and the carrier component contains the fabric softener component within the composition and allows the fabric softener component to transfer to wet laundry; and (b) drying laundry in the dryer in the presence of the fabric softener composition, wherein the composition does not melt during operation of the dryer.

2. A method according to claim 1, wherein the fabric softener composition loses between about 0.01 gram and about 1.0 gram per pound of dry laundry for each drying cycle.

3. A method according to claim 1, wherein the dryer comprises a tumble dryer.

4. A method according to claim 1, wherein the fabric softener composition has a size of at least about 5 grams.

5. A method according to claim 1, wherein the step of drying laundry in the dryer in the presence of the fabric softener composition comprises allowing the water in the laundry to solubilize the fabric softener component and transfer to the laundry.

6. A method according to claim 1, wherein the rate of transfer of the fabric softener component to the laundry decreases as the laundry dries.

7. A method according to claim 1, wherein the composition is provided as a block or strip having a size of between about 30 grams and about 170 grams.

8. A method according to claim 1, wherein the carrier component comprises at least one of ethylene bisamides, primary alkylamides alkanolamides, polyamides, alcohols containing at least 12 carbon atoms, alkoxylated alcohols containing at least 12 carbon atoms, carboxylic acids containing at least about 12 carbon atoms, derivatives thereof, or mixtures thereof.

9. A method for using a fabric softener composition, the method comprising steps of:

(a) attaching a fabric softener composition to an inside wall of a dryer, wherein the fabric softener composition comprises a result of melt mixing and molding a fabric softener component and a carrier component at a weight ratio of the fabric softener component to the carrier component of between about 1:19 and about 19:1 to provide a fabric softener composition exhibiting a melting point greater than 90° C., wherein the fabric softener component provides fabric softening properties to laundry during a drying operation of wet laundry in a dryer, and the carrier component contains the fabric softener component within the composition and allows the fabric softener component to transfer to wet laundry, wherein the carrier component comprises at least one of ethylene bis-stearamide, ethylene bisoleamide, or ethylene bisbehenamide; and (b) drying laundry in the dryer in the presence of the fabric softener composition.

10. A method according to claim 9, wherein the fabric softener composition loses between about 0.01 gram and about 1.0 gram per pound of dry laundry for each drying cycle.

11. A method according to claim 9, wherein the dryer comprises a tumble dryer.

12. A method according to claim 9, wherein the fabric softener composition has a size of at least about 5 grams.

13. A method according to claim 9, wherein the step of drying laundry in the dryer in the presence of the fabric softener composition comprises allowing the water in the laundry to solubilize the fabric softener component and transfer to the laundry.

14. A method according to claim 9, wherein the rate of transfer of the fabric softener component to the laundry decreases as the laundry dries.

15. A method according to claim 9, wherein the composition does not melt during operation of the dryer.

16. A method according to claim 9, wherein the composition is provided as a block or strip having a size of between about 30 grams and about 170 grams.

* * * * *